United States Patent [19]

Woodsum et al.

[11] Patent Number: 4,719,649

[45] Date of Patent: Jan. 12, 1988

[54] AUTOREGRESSIVE PEEK-THROUGH COMJAMMER AND METHOD

[75] Inventors: Harvey C. Woodsum, Nashua, N.H.; Albin A. Hastbacka, Chelmsford, Mass.

[73] Assignee: Sanders Associates, Inc., Nashua, N.H.

[21] Appl. No.: 800,873

[22] Filed: Nov. 22, 1985

[51] Int. Cl.[4] ..... H04K 3/00

[52] U.S. Cl. ..... 455/1; 381/71; 342/14; 342/16

[58] Field of Search ..... 455/1, 73, 78, 79; 343/18 E, 18 R; 331/78; 381/71, 73, 71.1; 342/14, 16

[56] References Cited

U.S. PATENT DOCUMENTS

| | | | |
|---|---|---|---|
| 3,739,281 | 6/1973 | Deserno et al. . | |
| 4,247,946 | 1/1981 | Mawhinney . | |
| 4,417,098 | 11/1983 | Chaplin et al. | 381/71 |
| 4,438,526 | 3/1984 | Thomana | 381/73 |
| 4,506,379 | 3/1985 | Komatsu | 381/73 |
| 4,549,289 | 10/1985 | Schwartz et al. | 381/71 |
| 4,566,118 | 1/1986 | Chaplin et al. | 381/71 |
| 4,594,695 | 6/1986 | Garconnat et al. | 381/71 |

OTHER PUBLICATIONS

Markel, J. D. and Gray, A. H., Jr., "On Autocorrelation Equations as Applied to Speech Analysis", in *IEEE Transactions on Audio and Electroacoustics,* vol. AU-21, No. 2, Apr. 1973, pp. 69–79.

Kay, S. M. and Marple, S. L., Jr., "Spectrum Analysis—A Modern Perspective", in *Proceedings of the IEEE,* vol. 69, No. 11, Nov. 1981, pp. 1380–1419.

Marple, Jr., S. Lawrence, 'Corrections to "Spectrum Analysis—A Modern Perspective"', in *Proceedings of the IEEE,* vol. 70, No. 10, Oct. 1982, p. 1238.

van Schooneveld, C. and Sondag, M., "Spectrum Analysis: On the Application of Data Windowing to Kay and Marple's Results", in *Proceedings of the IEEE,* vol. 71, No. 6, Jun. 1983, pp. 776–779.

'Correction to "Spectrum Analysis: On the Application of Data Windowing to Kay and Marple's Results"', in *Proceedings of the IEEE,* vol. 71, No. 11, Nov. 1983, pp. 1324–1325.

Markel, J. D. and Gray, Jr., A. H., *Linear Prediction of Speech,* Springer-Verlag, Berlin, Heidelberg, New York, 1976, pp. 190–211.

*Primary Examiner*—Robert L. Griffin
*Assistant Examiner*—Elissa Seidenglanz
*Attorney, Agent, or Firm*—Richard I. Seligman; Stanton D. Weinstein

[57] ABSTRACT

Disclosed and claimed in a communications system which permits the simultaneous reception and jamming of a transmitted radio frequency signal. This is accomplished by sampling the signal for a minimal period with the jammer off, operating the jammer for a much longer time than was previously thought possible, then using the coefficients output from a linear prediction filter to provide an estimate signal from the transmitted signal while the jammer transmitter is on. The coefficients may be smoothed by averaging over several segments. In addition, if the transmitted signal was a voice signal, voiced-unvoiced decision logic may be used to improve the system's performance.

30 Claims, 4 Drawing Figures

AUTOREGRESSIVE PEEK-THROUGH COMJAMMER AND METHOD

BACKGROUND OF THE INVENTION

The present invention relates to communications jamming equipment and more particularly to an autoregressive peek-through communications system which permits simultaneous jamming and reception of a transmitted signal.

Communications jamming equipment has found use in situations in which it is desirable to prevent someone else from obtaining transmitted information. Typically, the information is a voice signal sent by a transmitter over a radio band, and an attempt is made to prevent the intended receiver from receiving the message.

One such technique, called look-through jamming, begins with the jamming transmitter in the "off" position and the jamming receiver looking for the existence of a transmission. When the jamming receiver detects that a transmitter has turned on, the jamming transmitter is operated nearly continuously but with periodic interruptions. The periodic interruptions, on the order of once every several seconds, are necessary to determine if the transmitter is still operating. Once the transmitter goes away, then of course, the jamming equipment can be turned off.

Another technique is the use of peek-through jamming. In this technique, an attempt is made to simultaneously jam and demodulate the transmitted signal. The jammer transmitter is operated for a period of time and then turned off for a short interval to allow a sample of the transmitted signal to be taken. The sampling takes place at or near the Nyquist rate. Thus, in the case where the transmitted signal is a voice signal, the jammer is turned on and off at the rate of approximately 6 khz of two times the normal voice bandwidth of 3 khz. The voice signal is reconstructed by low pass filtering of the samples taken.

The block diagram of such a prior art system, capable of performing both look-through and peek-through jamming is in FIG. 1. The system comprises a receiver section 70 and a transmitter section 80. The receiver 70 consists of appropriate antenna apparatus 10, RF demodulator circuit 12, sampler 18, low pass filter 14 and detection equipment 30. The jammer transmitter 80 comprises a signal generator 51, power switch 55, an RF modulator 56, bandpass filter 58, and transmit antenna 60 which may or may not be the same physical structure as receive antenna 10. In operation, either the receiver 70 or the jammer 80 is active at any given instant in time. So when, for example, power switch 55 is closed, enabling the jammer transmitter 80 to operate, the sampler 18 will be in the open position so that a sample is not being taken. Likewise, when switch 18 is closed, indicating that a sample is being taken, the jammer transmitter 80 will be deactivated by opening power switch 55.

U.S. Pat. No. 3,739,281 to Deserno et al. is an example of a look-through jamming system. It illustrates one technique for temporarily inactivating the jammer transmitter and searching through the radio band to determine if the transmitted signal is still present.

U.S. Pat. No. 4,247,946 to Mawhinney is of general interest, as it discloses a circuit capable of accurately sampling the transmitted signal as would be done by the sampler 18, and other circuitry related to accurate signal detection as would be performed by the detection equipment 30.

One of the difficulties with existing peek-through jamming equipment is that it is desirable to minimize the jammer off time, in order to maximize the effect of making the transmission unintelligible. For most radio communications situations, this also means that high powered RF amplifiers must be switched on the order of tens of microseconds, which in turn limits the amount of jamming power which can be used.

Another problem with such systems is that an intelligent transmitter might determine that it was being jammed and synchronize itself to the jammer sampling rate so that no information is sent while the jammer is off.

SUMMARY OF THE INVENTION

It is the general object of the present invention to provide an improved type of communications jamming system capable of simultaneously jamming and detecting the transmitted signal.

Another object of the invention is to minimize the sampling time necessary and thus maximize the time which the jammer may be operated in the on state.

A further object is to make it more difficult for the transmitter and intended receiver to detect or synchronize to the jammer transmitter.

Briefly, these and other objects of the invention are accomplished by sampling the transmitted signal for a minimal period, and operating the jammer transmitter for a much longer time than was done in the prior art, and performing a linear prediction technique on samples of the transmitted signal, to provide an estimate of values of the transmitter signal during the jammer transmitter's operation. An intelligible voice signal is then constructed by using the linear prediction coefficients to resynthesize an approximation of the missing voice information.

The technique has been found to be particularly useful when the transmitted signal is a human speech signal. This is possible because speech signals comprise voiced and/or unvoiced segments. The voiced segments have the characteristic of being periodic (this period being known as the pitch period). Unvoiced segments have properties much like noise. A preliminary voiced or unvoiced determination is made from a block of speech samples approximately equal in length to the pitch period. If the speech is voiced, then the prediction filter is excited in a periodic fashion while the jammer transmitter is on, and if the speech segment is unvoiced, then noise is used to excite the filter. Assumptions necessary for proper operation of the invention are that the interval of time when continuous speech is available is less than one pitch period, that the signal-to-noise ratio is relatively good (greater than 10 db) and that an allpole linear predictive model is sufficient to characterize the speechware form.

These and still further objects, advantages and other features will become apparent from the following detailed description and the accompanying drawings.

DESCRIPTION OF THE PREFERRED EMBODIMENT

Figure 1:
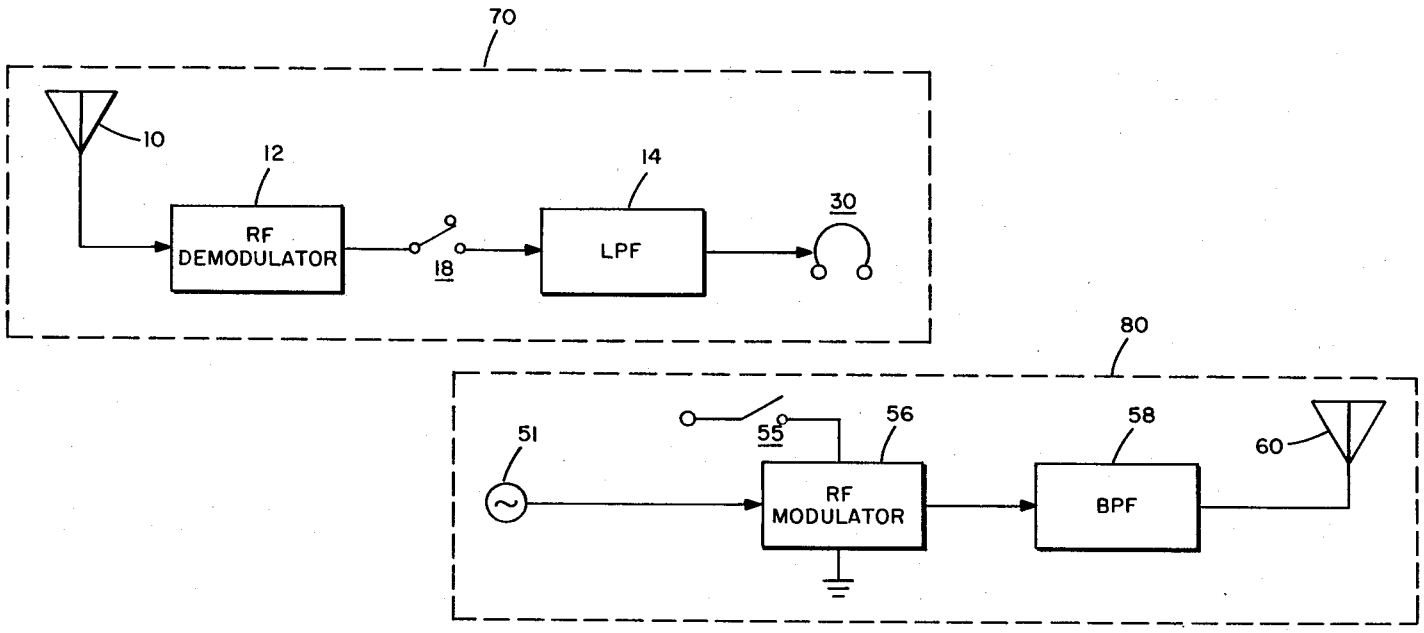
FIG. 1 PRIOR ART
FIG. 1 is a block diagram of a prior art apparatus used for communications jamming.
Figure 2:
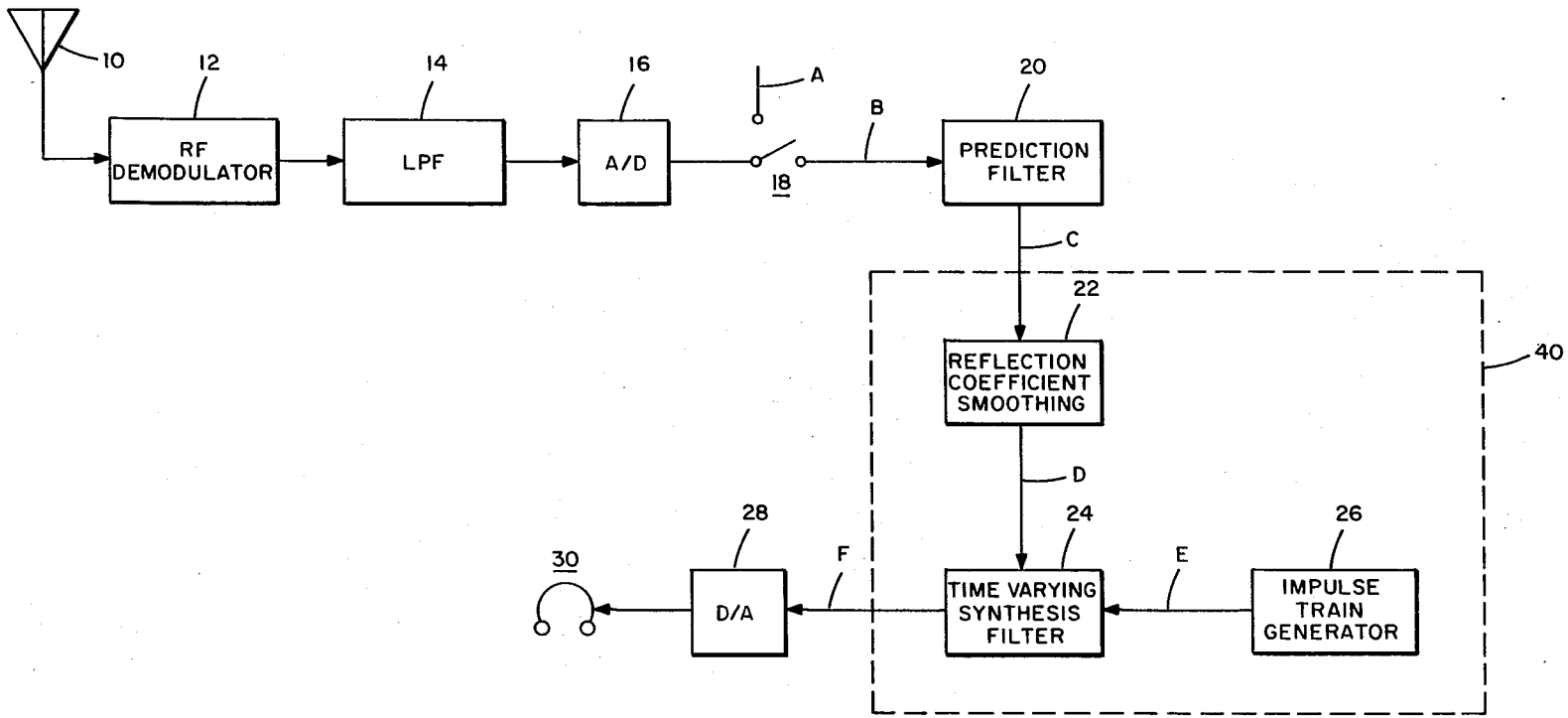
FIG. 2 is a block diagram of a jammer receiver according to the present invention.

Referring now in more detail to the drawings in which like reference characters designate like or corresponding parts or signals throughout the several views, there is shown in FIG. 2 a block diagram of the jammer receiver. The antenna 10, RF demodulator 12, and lowpass filter 14 are identical to the common elements of a conventional radio receiver. The output of antenna 10 is an electrical signal corresponding to the transmitted signal, and is coupled to the input of RF demodulator 12, which translates the received electrical signal from the transmitted center frequency to a convenient baseband frequency. The output of RF demodulator 12 is then fed to lowpass filter 14 which removes the intermediate frequency, leaving at the output of lowpass filter 14 the baseband electrical signal.

The baseband electrical signal is then converted to digital form by analog-to-digital converter 16. This analog-to-digital converter 16 converts the analog transmitted signal to a series of digital numbers, each number indicating a voltage The output of analog-to-digital converter 16 is then fed to a switch 18. The switch 18 is placed in position A while the jammer transmitter is being operated and in position B while the receiver electrical signal is being sampled. Thus, the signal at B will be a series of digital pulses in which there will be a group of pulses corresponding to the values of the transmitted signal and then a larger group of pulses with a zero value. The switch 18 is switched from position A to position B by a periodic clock (not shown) or a clock which is operated in a pseudo-random manner.

The prediction filter 20 operates independently on each group of actual samples of the transmitted signal. For each group of samples, prediction filter 20 performs a linear prediction operation as described by Kay, S. M. and Marple, S. L., Jr. in "Spectrum Analysis-A Modern Perspective", *Proceedings of the IEEE,* Vol. 69, No. 11, November 1981, pp 1380–1419. While in many applications it is the actual pole positions which are the desired quantity, here it is the values of the autocorrelation normal equation, otherwise known as the reflection coefficients which are output at C.

This resynthesis operation is performed by synthesizer 40. The first step is to smooth the reflection coefficients output at C, performed by reflection coefficient smoothing 22. This device 22 performs smoothing by a suitable averaging technique. In the preferred embodiment, the smoothing is accomplished by a cubic spline interpolation over the three most recent sets of reflection coefficients. The smoothed coefficients are then output at D, and sent to time varying synthesis filter 24. Also input to synthesis filter 24 at E is an impulse train, generated by impulse train generator 26. The space between impulses corresponds to the sampling rate used in analog-to-digital converter 16. Synthesis filter 24 is a digital filter implemented as a lattice structure as described in Oppenheim, A. V., and Schafer, R. W. *Digital Signal Processing* (Englewood Cliffs, N.J.: Prentice-Hall, 1975). The smoothed reflection coefficients D, determine the pole locations of the filter, and impulse train E serves as the input signal to the filter. The output F of the filter 24 is the resynthesized voice signal. The resynthesized voice signal F is then input to digital-to-analog converter 28, thereby producing an analog signal which is then provided to detector 30.

Figure 3:
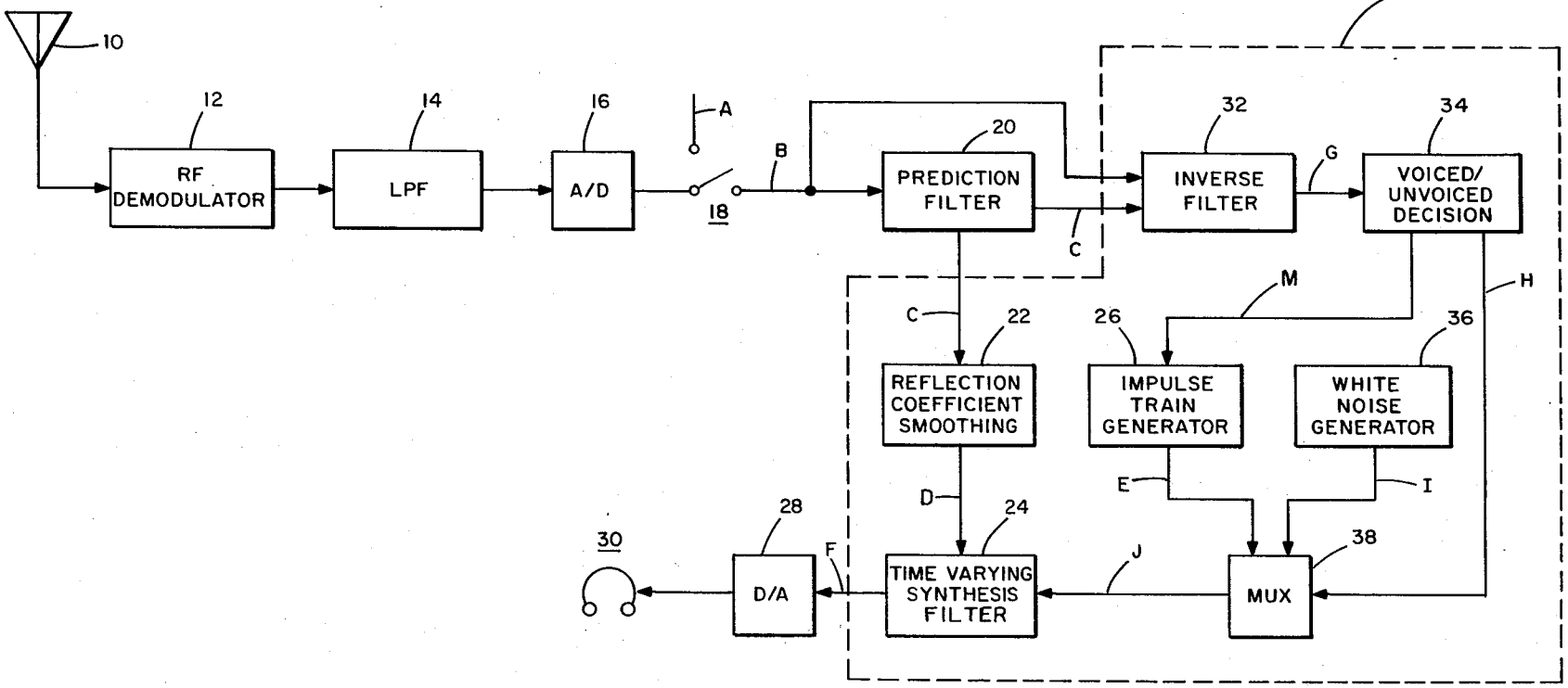
FIG. 3 is a block diagram illustrating an alternative embodiment of the jammer receiver of the present invention.

A refinement of the invention is possible which takes advantage of the aforementioned characteristic of voice signals to have periodic or voiced portions and noise-like or unvoiced portions. Thus an alternative embodiment of synthesizer 40, depicted in FIG. 3, is particularly appropriate in applications where a voice signal is to be jammed.

In this instance, advantage can be taken of the fact that transmitted speech signals often have a bandwidth of about 3 Khz. This bandwidth comprises a plurality of very narrow tones which are typically 50 Hz wide and spaced approximately 500 Hz apart. Thus, since the bandwidth of the information actually contained in the speech signal is quite small, the received signal can be sampled in much smaller groups of approximately 5 to 10 milliseconds in length. The received signal can then be jammed for a relatively long period of time, approximately 400 to 800 milliseconds. The sampled information is then extrapolated to approximate the true values of the transmitted signal during the 400 to 800 millisecond jamming period.

This synthesizer 40 performs the same reflection coefficient smoothing 22 on the reflection coefficients C as described above as well as using the smoothed reflection coefficients D to determine the pole locations of the time varying synthesis filter 24. However, the signal J used to excite the synthesis filter 24 is different in this instance. Inverse filter 32 receives as input the reflection coefficients C as well as the sample data signal B. Inverse filter 32 is a digital filter implemented in lattice form in the same manner as synthesis filter 24. However, the filter is designed so that its transfer function is the reciprocal of the transfer function of the filter predicted by prediction filter 20. This inverse filter 32 then, has the effect of removing the predictable variations in the sample signal B. The signal G is thus a signal containing only unpredictable portions. Signal G is then input to voiced-unvoiced decision logic 34. This decision logic 34 decides, within less than the pitch period, whether or not the particular segment being sampled is voiced or unvoiced. This problem is essentially the same as the problem of pitch period extraction, the unvoiced segments corresponding to a very short or nearly zero length pitch period, and the voiced segments corresponding to a longer period. A number of techniques for pitch period extraction are discussed in Markel, J. and Gray, A., *Linear Prediction of Speech* (New York: Springer-Verlag, 1976) pp. 190–211. However, given the time constraints in the present invention, the preferred embodiment of decision logic 34 is a circuit which counts the number of zero crossings. If the number of crossings exceeds a small number, say two or three, the segment is labeled a voiced segment. The voiced-unvoiced logic signal H then is used to control a multiplexer 38 which selects either the impulse train output E of impulse train generator 26 or the noise output signal I from white noise generator 36, depending on whether the signal is voiced or unvoiced, respectively. Signal J is, then, a series of impulse trains and white noise segments corresponding to the voiced and unvoiced portions of the sampled portion of the transmitted voice signal. As previously discussed, this excitation signal J is then used to excite synthesis filter 24 producing estimated signal F. The estimated signal F is then input to digital-to-analog converter 28 before being input to detector 30.

It is also evident that the number corresponding to the estimate of the pitch period calculated by voiced-unvoiced decision logic 34 can be output at M and used to control the spacing between impulses in the signal E produced by impulse train generator 26.

Figure 4:
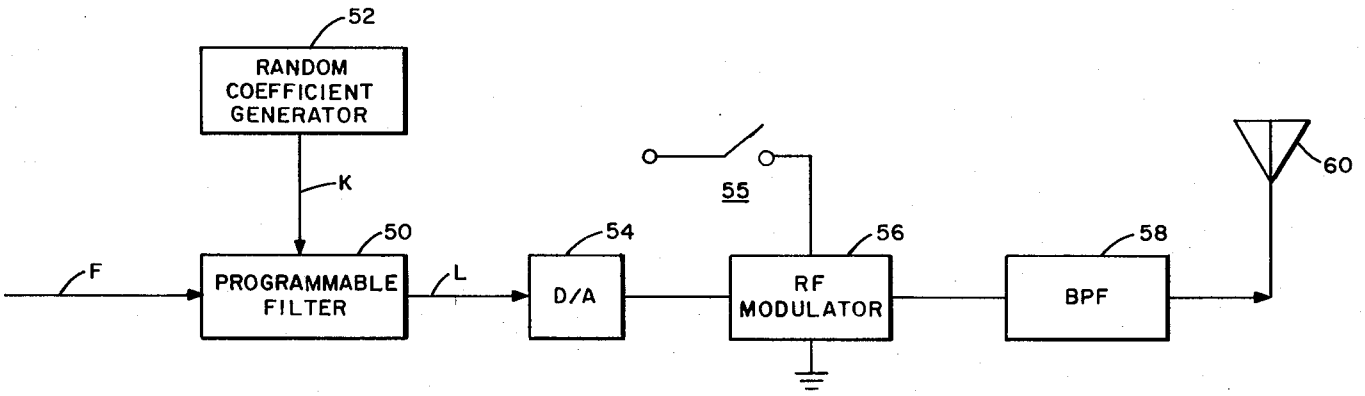
FIG. 4 is a block diagram illustrating the jammer transmitter of the present invention.

FIG. 4 is a block diagram of the jammer transmitter portion of the present invention. The improvement here is to foil the intended receiver from attempting to reconstruct the transmitted signal in the same manner as the receivers of FIG. 2 and FIG. 3. The present invention achieves this result by producing a jamming signal which has the spectral qualities similar to a speech signal but is, in fact, unintelligible. This has the two-fold effect of more efficiently using the available energy in the jammer transmitter, because the energies will be concentrated in the few narrow bands actually used in human speech signals, as well as being more difficult to detect. The reconstructed speech signal F is used as an input signal to a programmable digital filter 50. This digital filter is also of a lattice structure. The filter coefficients K, however, are randomly generated by the random coefficient generator 52. This generator uses any one of a number of well-known techniques to generate uniformly distributed random numbers. With the resulting output of programmer filter 50 then, a garbled speech signal L will have the spectral properties of a speech signal, but it, in fact, will be unintelligible. This signal is then in turn input to digital to analog converter 54, power amplified (not shown) and then input to RF modulator 56. This modulator 56 is switched on and off synchronously with switch 18 of FIGS. 2 and 3. It is on during the jamming periods and off during the listening periods. The signal is then appropriately bandpass filtered 58 and amplified (not shown) before inputting to the transmitting antenna 60.

It should be noted that the digital filters 20, 32, 24 and 50, as well as coefficient smoothing 22, voiced-unvoiced decision logic 34, impulse train generator 26, white noise generator 36, and random coefficient generator 52, can be appropriately performed by a digital logic or a microprocessor programmed to create the indicated steps.

It should also be noted that the above-described invention can be generalized for other non-voice signals, as long as they are comprised of noise-like portions and periodic or predictable portions.

Of course, the receiver of the present invention could be used with a conventional jammer transmitter, as well as a conventional receiver being used with the jamming transmitter of the present invention.

A pseudo-random clock generator could be used to control the switches 18 and 55 so that it becomes more difficult for an intelligent intended receiver to synchronize to the jamming operation.

Other advantages and modifications of the present invention may be possible and evident to those skilled in the art. Therefore, it should be understood that the intent is to limit the present invention only by the scope of the claims which follow:

Whereas, I claim:

1. An apparatus for receiving and jamming a transmitted signal, comprising:

(a) an analog to digital converter connected to receive a transmitted signal, thereby providing a digital signal;

(b) a transmitter that is alternately switched on and off to jam the transmitted signal;

(c) means, connected to receive as an input the digital signal, for producing a sampled digital signal of value substantially equal to the value of the digital signal when said transmitter is off, and equal to a zero value when said transmitter is on;

(d) a linear prediction filter connected to receive as an input the sampled digital signal, thereby providing an estimate of the correct values of the transmitted signal when said transmitter is on, the estimate in the form of a set of reflection coefficients; and (e) means for generating a digital synthesized transmitted signal, connected to receive the set of reflection coefficients as an input.

2. An apparatus as recited in claim 1 wherein the transmitted signal is a voice signal having discernable pitch periods.

3. An apparatus as recited in claim 1 wherein said means for generating a digital synthesized transmitted signal comprises:

means for smoothing reflection coefficients connected to receive the set of reflection coefficients and in response thereto producing a set of smoothed reflection coefficients.

4. An apparatus as recited in claim 3 wherein said means for smoothing reflection coefficients comprises means for cubic spline interpolation.

5. An apparatus as recited in claim 1 wherein said means for generating a digital synthesized transmitted signal comprises:

means for providing an excitation signal, and a digital lattice filter connected to receive the set of reflection coefficients and the excitation signal, thereby providing the digital synthesized transmitted signal.

6. An apparatus as recited in claim 5 wherein said means for providing an excitation signal comprises an impulse train generator.

7. An apparatus as recited in claim 5 wherein the transmitted signal is a voice signal, and wherein said means for providing an excitation signal comprises:

means, connected to receive the sampled digital signal, for determining if a given portion of the transmitted signal is voiced or unvoiced and providing a voiced-unvoiced decision signal indicative of such determination; and means, connected to receive the voiced-unvoiced decision signal, for generating an excitation signal in which impulse trains correspond to voiced segments of the sampled digital signal and white noise corresponds to unvoiced segments of the sampled digital signal.

8. An apparatus as recited in claim 7 wherein said means for generating a digital synthesized transmitted signal comprises means for smoothing reflection coefficients connected to receive the set of reflection coefficients and in response thereto producing a set of smoothed reflection coefficients; and wherein said means for determining comprises an inverse filter connected to receive the sampled digital signal and the set of smoothed reflection coefficients thereby providing a filtered sampled digital signal in which predictable variations of the transmitted signal have been removed.

9. An apparatus as recited in claim 7 wherein said means for generating an excitation signal comprises:

means for producing an impulse train signal;

means for producing white noise; and a multiplexer, connected to receive the impulse train signal, the white noise and the voiced-unvoiced decision signal, for variously producing the impulse train signal or the white noise as the excitation signal, in response to the voiced-unvoiced decision signal.

10. An apparatus as recited in claim 1 wherein said transmitter is alternately switched on and off in a pseudo-random sequence.

11. An apparatus as recited in claim 1 wherein said transmitter comprises:

means for generating random reflection coefficients;

means for generating an excitation signal; and a digital filter connected to receive the random reflection coefficients and the excitation signal to provide a jamming signal.

12. An apparatus as recited in claim 1 wherein said transmitter comprises a jammer transmitter.

13. A method for simultaneously listening and jamming a transmitted voice signal, comprising the steps of:

(a) demodulating the transmitted signal;

(b) digitizing the transmitted signal;

(c) storing a portion of the digitized signal approximately equal to the pitch period of the voice signal;

(d) jamming the transmitted signal for a period of time approximately equal to five times the pitch period; and (e) using a linear prediction method and the stored portion of the digitized signal to estimate the contents of the voice signal during the jamming period.

14. A method as recited in claim 13 wherein:

said using step comprises producing reflection coefficients indicative of the estimate; and said method for simultaneously listening and jamming further comprises the step of smoothing the reflection coefficients with an interpolation method.

15. A method as recited in claim 14 wherein said step of smoothing the reflection coefficients comprises fitting a cubic spline to each set of three reflection coefficients.

16. A method as recited in claim 13 further comprising the steps of: making a voiced/unvoiced decision and; switching on an impulse train generator during voiced periods and a white noise generator during unvoiced periods.

17. A method as recited in claim 13 wherein said step of jamming the transmitted signal comprises the steps of:

(i) generating random reflection coefficients; and (ii) using the reflection coefficients to excite a programmable digital filter, thereby generating the jamming signal.

18. An apparatus as recited in claim 8 wherein said means for determining comprises an inverse filter connected to receive the sampled digital signal and the set of smoothed reflection coefficients thereby providing, in said means for determining, a filtered sampled digital signal in which predictable variations of the transmitted signal have been removed.

19. A method as recited in claim 16 wherein said step of making a voiced/unvoiced decision comprises:

counting the number of zero crossings in a segment of the digitized signal.

20. A method as recited in claim 16 wherein said step of making a voiced/unvoiced decision comprises:

extracting the pitch period of a segment of the digitized signal.

21. A signal processing system, comprising:

an analog-to-digital converter receiving a first analog signal and producing a first digital signal;

sampling means receiving the digital signal for sampling the first digital signal and producing a sampled digital signal;

first filter means receiving the sampled digital signal for performing a linear prediction operation on each sample of the first digital signal and producing a signal indicative of the reflection coefficients to the sampled digital signal;

smoothing means receiving the reflection coefficients for smoothing the reflection coefficients;

first generator means for producing an impulse train signal; and second filter means receiving the impulse train signal and the smoothed reflection coefficients for producing a resynthesized signal, wherein the smoothed reflection coefficients determine the pole locations of said second filter means and said second filter means filters the impulse train signal to produce the resynthesized signal.

22. A signal processing system as recited in claim 21 wherein said smoothing means comprises means for averaging the reflection coefficients.

23. A signal processing system as recited in claim 21 wherein said smoothing means comprises means for performing a cubic spline interpolation over the reflection coefficients for the three most recent segments of said digitized signal.

24. A signal processing system as recited in claim 21 wherein said generator means comprises means for generating an impulse train signal comprising a series of impulses spaced by the sampling rate of said analog-to-digital converter.

25. A signal processing system as recited in claim 21 wherein said second filter means comprises a digital filter implemented as a lattice structure.

26. A signal processing system as recited in claim 21 further comprising:

a digital-to-analog converter receiving the resynthesized signal and producing a second analog signal.

27. A signal processing system as recited in claim 21 further comprising:

a low-pass filter receiving a demodulated signal for producing the first analog signal; and a demodulator receiving a first signal for producing the demodulated signal.

28. A signal processing system as recited in claim 21, further comprising:

second generator means for generating uniformly distributed random numbers;

third filter means receiving the uniformly distributed random numbers and the resynthesized signal for producing a second digital signal, wherein the uniformly distributed random numbers determine coefficients of said third filter means and said third filter means filters the resynthesized signal to produce the second digital signal;

a digital-to-analog converter receiving the second digital signal for producing a second analog signal; and a modulator receiving the second analog signal for producing a modulated signal except while said sampling means is taking a sample of the first digital signal.

29. A signal processing system, comprising:

an analog-to-digital converter receiving a first analog signal and producing a first digital signal;

sampling means receiving the first digital signal for producing a sampled digital signal;

first filter means, receiving the sampled digital signal, for producing the reflection coefficients of the sampled digital signal;

a second filter whose transfer function is substantially the reciprocal of the transfer function of said first filter means, receiving the reflection coefficients and the sampled digital signal;

decision means receiving a signal produced by said digital filter for producing a signal indicative of whether a sample of the first digital signal is voiced or unvoiced and for producing a signal indicative of the pitch period of such sample;

means, receiving the indicative signal, for producing an impulse train signal;

means for producing white noise;

a multiplexer, connected to receive the impulse train signal, the white noise and the voiced-unvoiced decision signal for variously producing the impulse train signal or the white noise as an output signal, in response to the voiced-unvoiced decision signal;

smoothing means receiving the reflection coefficients for smoothing the reflection coefficients; and second filter means receiving the impulse train signal and the smoothed reflection coefficients for producing a resynthesized signal, wherein the smoothed reflection coefficients determine the pole locations of said second filter means and said second filter means filters the impulse train signal to produce the resynthesized signal.

30. A signal processing system as recited in claim 29, further comprising:

means for generating uniformly distributed random numbers;

third filter means receiving the uniformly distributed random numbers and the resynthesized signal for producing a second digital signal, wherein the uniformly distributed random numbers determine coefficients of said third filter means and said third filter means filters the resynthesized signal to produce the second digital signal;

a digital-to-analog converter receiving the second digital signal for producing a second analog signal; and a modulator receiving the second analog signal for producing a modulated signal except while said sampling means is taking a sample of the first digital signal.

* * * * *